US007477857B2

(12) United States Patent
Yokogawa

(10) Patent No.: US 7,477,857 B2
(45) Date of Patent: Jan. 13, 2009

(54) DEVELOPING UNIT, IMAGE FORMING DEVICE, AND DEVELOPING BIAS CONTROL METHOD

(75) Inventor: Tadahiro Yokogawa, Uji (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 251 days.

(21) Appl. No.: 11/421,813

(22) Filed: Jun. 2, 2006

(65) Prior Publication Data

US 2006/0280514 A1 Dec. 14, 2006

(30) Foreign Application Priority Data

Jun. 13, 2005 (JP) ..... 2005-173018

(51) Int. Cl.
*G03G 15/06* (2006.01)

(52) U.S. Cl. ..... 399/55; 399/119

(58) Field of Classification Search ..... 399/24, 399/25, 38, 53, 55, 107, 11, 111, 119, 120
See application file for complete search history.

(56) References Cited

U.S. PATENT DOCUMENTS 5,995,774 A * 11/1999 Applegate et al. ..... 399/27
6,944,410 B2 * 9/2005 Naito et al. ..... 399/27
7,221,467 B2 * 5/2007 Hayashi et al. ..... 358/1.15
7,233,747 B2 * 6/2007 Tomitaka ..... 399/12

FOREIGN PATENT DOCUMENTS

| | | | |
|---|---|---|---|
| JP | 63-083768 | A | 4/1988 |
| JP | 07-160157 | A | 6/1995 |
| JP | 10-239962 | A | 9/1998 |
| JP | 2001-022230 | A | 1/2001 |
| JP | 2002-169431 | A | 6/2002 |
| JP | 2002-328514 | A | 11/2002 |

* cited by examiner

*Primary Examiner*—Hoan H Tran
(74) *Attorney, Agent, or Firm*—Keating & Bennett, LLP

(57) ABSTRACT

An image forming device includes a developing unit, which is removably inserted in the image forming device, and the developing unit includes an accumulating chamber, a developing member, and a storage medium. The accumulating chamber accumulates developer. The developing member moves the developer onto an image carrier and carries out an image forming process. The storage medium stores control information for determining a developing bias to be applied to the developing member, and usage performance information of the developing unit necessary for determining the developing bias.

10 Claims, 5 Drawing Sheets

DEVELOPING UNIT, IMAGE FORMING DEVICE, AND DEVELOPING BIAS CONTROL METHOD

BACKGROUND OF THE INVENTION

1. Field of the Invention

The present invention relates to an image forming device, such as a copy machine, a printer, and a facsimile machine, and a developing unit included in the image forming device.

2. Description of the Related Art

A well-known electrophotographic image forming device uses a photoconductive drum as an image carrier. By charging and exposing a surface of the photoconductive drum, an electrostatic latent image is formed on the surface of the photoconductive drum. Toner adheres onto the electrostatic latent image, and a visible image is formed. This visible image is transferred onto paper. In such an image forming device, components are unitized according to necessity, and this unit is removably inserted in the image forming device. When a replacement timing of the components arrives, the unit is replaced as appropriate. In particular, a developing unit containing the toner, which is consumable, is replaced when a remaining amount of the toner becomes low. The photoconductive drum and the developing unit may be integrally provided as one unit.

In order to accurately grasp the replacement timing of such a unit to be replaced, information indicating an arrival of the replacement timing is loaded in the unit. For example, according to a first conventional device, a unit includes a nonvolatile memory which stores identification data indicating a serial number of the unit and count data indicating a cumulative used time. Accordingly, the unit inserted in a main body of the image forming device can be distinguished. Each unit includes the memory which stores the used time associated with the identification data. According to a second conventional device, a cumulative number of images is stored in a main body memory of a printer main body and a memory of a cartridge. When the cartridge is inserted in the printer main body, the cumulative number of images stored in the memory of the cartridge is read and stored into the main body memory of the printer main body. A number of sheets on which an image forming process has been performed is added to the cumulative number of images stored in the main body memory. After the image forming process has been completed, the cumulative number of images stored in the main body memory is also stored into the memory of the cartridge.

In the above-described image forming device, although a plurality of types of replaceable developing units are used, there is a disadvantage that a developing bias applied to a developing roller of the developing unit cannot be controlled accurately. The toner accumulated in the developing unit is charged while being agitated, and the toner adheres onto the surface of the photoconductive drum by an electric potential difference between the developing roller and the photoconductive drum. If the developing bias applied to the developing roller is not set according to a charged amount of the toner, a normal developing process cannot be carried out. The charged amount of the toner tends to decrease accompanying a usage performance of the developing unit (for example, a cumulative used time and a cumulative number of sheets on which the image forming process has been performed by the developing unit). Therefore, the developing bias is also required to be changed accompanying this tendency. However, when the developing unit is replaced, a usage performance of the image forming device does not match with the usage performance of the inserted developing unit. Therefore, if the developing bias is controlled in accordance with the usage performance of the image forming device, the developing bias does not match with the usage performance of the developing unit. Thus, the normal developing process becomes difficult to be carried out.

In the case of the conventional developing unit, when the remaining amount of the toner in the developing unit becomes low, the developing unit is replaced. However, reusable components such as a frame portion and a roller shaft of the developing unit are reused. With regard to the developing roller arranged in the developing unit, when a replacement timing of the developing roller arrives, the developing roller is replaced with a different developing roller. In this case, when a developing roller having a different developing property is installed, control information relating to the developing bias stored in the image forming device is required to be rewritten according to the newly installed developing roller. As a result, there is a restriction when replacing the developing roller, and the developing unit cannot be recycled efficiently.

SUMMARY OF THE INVENTION

In order to overcome the problems described above, preferred embodiments of the present invention enable a developing bias to be set accurately with respect to a developing unit and enable easy replacement of a developing roller.

According to a preferred aspect of the present invention, a developing unit includes an accumulating chamber, a developing member, and a storage medium. The accumulating chamber accumulates a developer. The developing member moves the developer onto an image carrier and carries out an image forming process. The developing unit is removably inserted in an image forming device. The developing unit includes a storage medium, which stores control information for determining a developing bias applied to the developing member and usage performance information of the developing unit necessary for determining the developing bias. The usage performance information is preferably a cumulative number of sheets on which the image forming process has been performed by the developing unit.

According to the above-described developing unit, a developing property of the developing unit can be stored in the developing unit. The image forming device including such a developing unit controls the developing bias in accordance with the control information and the usage performance information stored in the storage medium. Therefore, a developing process can be carried out accurately. When a developing roller having a different developing property is installed when recycling the developing unit, just the control information stored in the storage medium is required to be rewritten. The control information stored in the image forming device is not required to be rewritten. Therefore, since a recycling process is required to be performed only for the developing unit, the developing unit can be recycled efficiently.

The cumulative number of sheets on which the image forming process has been performed by the developing unit may be stored as the usage performance information. Accordingly, the developing bias can be finely controlled according to the cumulative number of sheets.

According to another preferred embodiment of the present invention, an image forming device includes the developing unit. The image forming device also includes a developing bias determining unit, a developing bias control unit, and a usage performance information updating unit. The developing bias determining unit reads the control information and the usage performance information from the storage medium, and determines the developing bias to be applied to the developing member. The developing bias control unit applies the developing bias determined by the developing bias determining unit to the developing member. The usage performance information updating unit updates the usage performance information stored in the storage medium in accordance with a usage performance of the developing unit.

According to the above-described image forming device, the developing bias can be controlled appropriately according to the developing unit. In addition, the usage performance information of the developing unit is updated in accordance with the usage performance of the inserted developing unit. Therefore, the usage performance information of the developing unit can be accurately maintained at all times.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
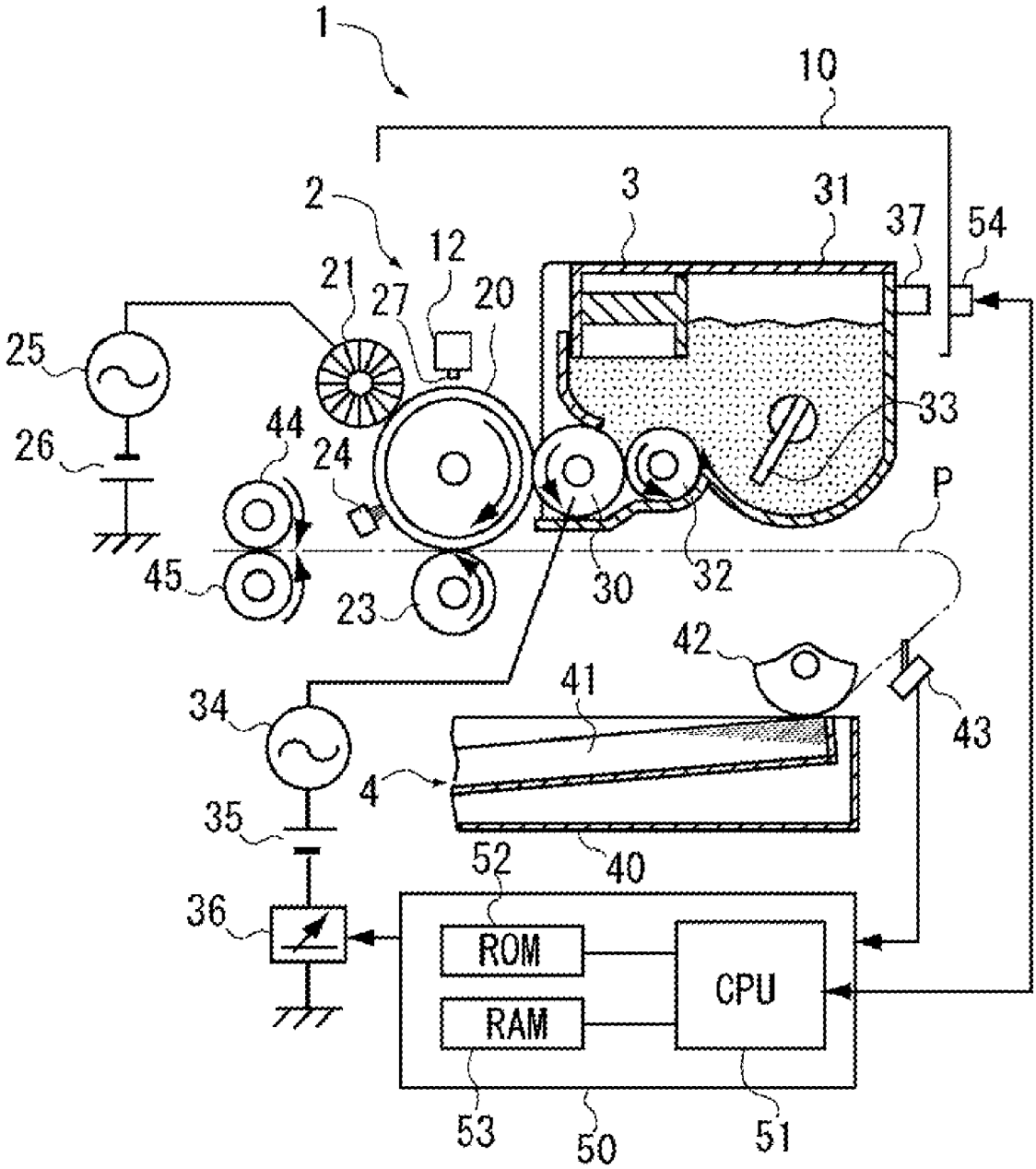
FIG. 1 is a schematic drawing illustrating the entire image forming device according to a preferred embodiment of the present invention.

FIG. 1 is a schematic drawing of an image forming device 1 including a developing unit according to a preferred embodiment of the present invention. A printer unit 2 is installed in a main body frame 10 of the image forming device 1. A developing unit 3 is removably inserted in the printer unit 2. The developing unit 3 supplies toner as a developer. A paper feeding unit 4 is installed in a lower portion of the main body frame 10.

The printer unit 2 includes a photoconductive drum 20 as an image carrier, a charging unit 21, an exposing device 12, a developing roller 30, a transfer roller 23, and a memory erasing brush 24. The charging unit 21 charges the surface of the photoconductive drum 20. The exposing device 12 exposes the charged surface of the photoconductive drum 20. The developing roller 30 develops an electrostatic latent image which has been formed by the toner. The transfer roller 23 assists in transferring a developed toner image onto paper 41. The memory erasing brush 24 scatters the toner remaining on the surface of the photoconductive drum 20 after the toner image has been transferred onto the paper 41.

The photoconductive drum 20 is rotatably supported on the main body frame 10. A photoconductive layer is provided on an outer circumferential surface of the photoconductive drum 20. The charging unit 21 includes a brush roller with conductive brushes. The brush roller is rotatably supported on the main body frame 10 so as to make contact with the surface of the photoconductive drum 20. A superposition voltage of alternating current (AC) and direct current (DC) is applied to the charging unit 21 from an AC power source 25 and a DC power source 26. A Light Emitting Diode (LED) array 27 is arranged on a lower surface of the exposing device 12. The LED array 27 irradiates light onto the photoconductive layer provided on the surface of the photoconductive drum 20. Accordingly, an electrostatic latent image based on image data is formed.

The developing unit 3 includes a toner case 31. The toner is accumulated in the toner case 31. A developing roller 30 and a supply roller 32 are supported rotatably in a lower portion of the toner case 31. An agitator 33 is supported in the toner case 31 for agitating the accumulated toner. When the developing unit 3 is inserted in the main body frame 10, the developing roller 30, the supply roller 32, and the agitator 33 are connected to a drive transmitting mechanism (not illustrated) and can be rotated by the drive transmitting mechanism.

An AC power source 34, a DC power source 35, and a variable power source 36 are connected to the developing roller 30 so that a predetermined developing bias is applied to the developing roller 30. A power source (not illustrated) is connected to the supply roller 32 so that a predetermined electric potential is applied to the supply roller 32.

The toner accumulated in the toner case 31 is agitated by the agitator 33 at all times. The toner is gradually charged. The charged toner is sequentially transported to the developing roller 30 by the supply roller 32. The toner adhered on the surface of the developing roller 30 is adjusted into an even layer thickness by a blade. According to an electric potential difference between the developing bias applied to the developing roller 30 and the electrostatic latent image formed on the surface of the photoconductive drum 20, the toner moves onto the surface of the photoconductive drum 20. A toner image is formed in the above-described manner.

A paper feed cassette 40 is removably inserted in the paper feeding unit 4. Papers 41 of a prescribed size are stacked in the paper feed cassette 40. The stacked papers 41 are fed one sheet at a time from an uppermost sheet by a paper feed roller 42. The paper 41 is transported along a transportation path P by transportation roller groups (not illustrated). The toner image is transferred onto the paper 41 between the photoconductive drum 20 and the transfer roller 23. Then, the paper 41 is sandwiched between a fixing roller 44 and a pressure roller 45, and the toner image is fixed onto the paper 41. Further, a paper detecting sensor 43 detects a number of papers 41 fed by the paper feed roller 42.

In the developing unit 3, an IC chip 37 as a storage medium is mounted on an outer surface of the toner case 31. In the main body frame 10, a reader/writer 54 is arranged at a position facing the IC chip 37. When the developing unit 3 is inserted in the main body frame 10, the reader/writer 54 is arranged at a position facing the IC chip 37 and becomes capable of reading and writing information stored in the IC chip 37.

Figure 2:
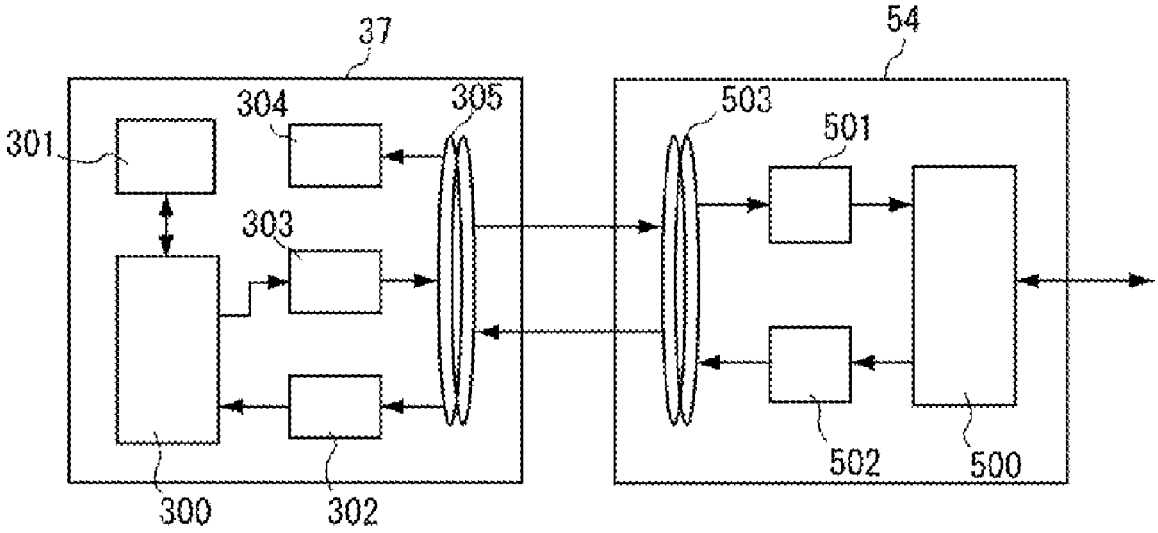
FIG. 2 is a circuitry diagram of an Integrated Circuit (IC) chip and a reader/writer according to a preferred embodiment of the present invention.

FIG. 2 is a circuitry diagram of the IC chip 37 and the reader/writer 54. The IC chip 37 includes a control circuit 300, a communication coil 305, a demodulation circuit 302, a modulation circuit 303, and a power supply circuit 304. The control circuit 300 carries out a reading process and a writing process of a memory 301. The demodulation circuit 302 demodulates a signal received by a communication coil 305, and inputs the demodulated signal to the control circuit 300. The modulation circuit 303 modulates the signal output from the control circuit 300, and transmits the modulated signal via the communication coil 305. The power source circuit 304 receives a power supply from the communication coil 305, and supplies the power to each component of the circuitry.

The reader/writer 54 includes a control circuit 500, a communication coil 503, a demodulation circuit 501, and a modulation circuit 502. The control circuit 500 is connected to a control unit of the image forming device 1, and carries out an information processing. The demodulation circuit 501 demodulates a signal received by the communication coil 503, and inputs the demodulated signal to the control circuit 500. The modulation circuit 503 modulates a signal output from the demodulation circuit 501 and the control circuit 500, and transmits the modulated signal via the communication coil 503. The IC chip 37 and the reader/writer 54 having such a circuitry are publicly known.

Figure 3:
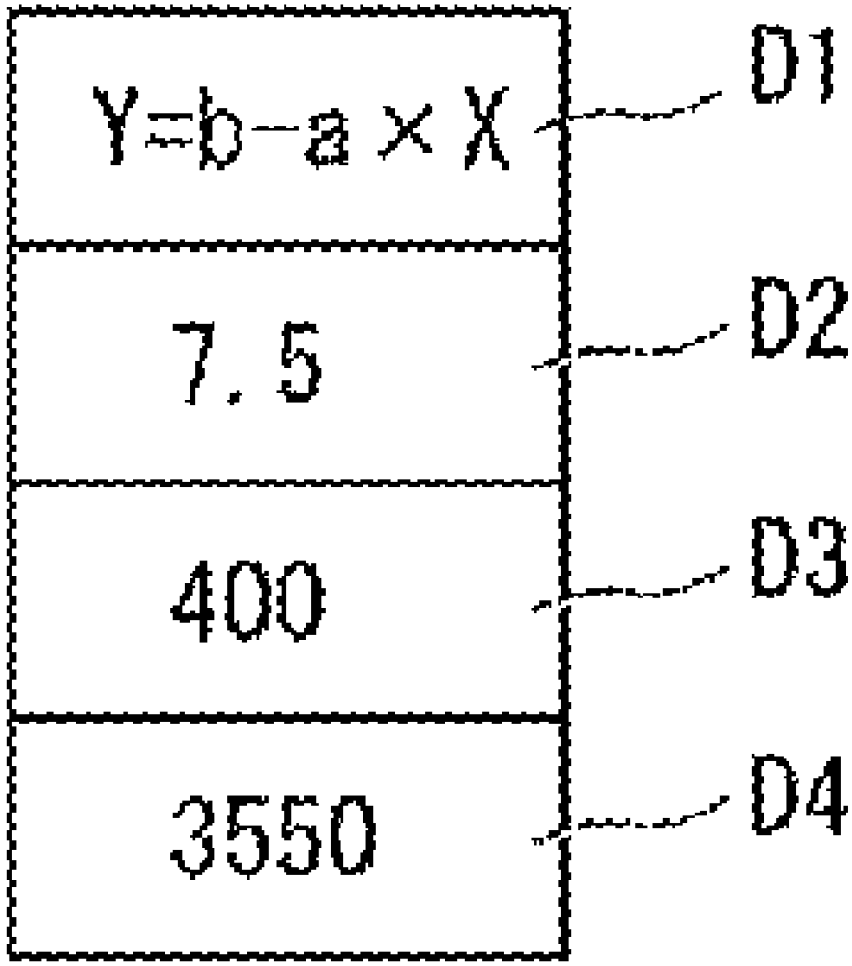
FIG. 3 illustrates a data structure stored in the IC chip according to a preferred embodiment of the present invention.

The memory 301 of the IC chip 37 stores information for determining a developing bias of the developing unit 3. FIG. 3 illustrates an example of such information stored in the memory 301. In the example illustrated in FIG. 3, the memory 301 stores data D1 relating to a function ($Y=b-a\times X$) for determining the developing bias, and data D2 and D3 respectively corresponding to invariables (a) and (b) to be used in the function. As usage performance data D4 of the developing unit 3, a cumulative number of sheets X on which the image forming process has been performed by the developing unit 3 is stored. Therefore, by reading these data, the developing bias to be applied to the developing roller 30 of the developing unit 3 can be determined. Further, as the usage performance data stored in the IC chip 37, a parameter relating to the developing bias can be used. For example, a cumulative used time of a driving motor or the developing roller 30 can be used. The usage performance data is not limited to the cumulative number of sheets in particular.

Figure 4:
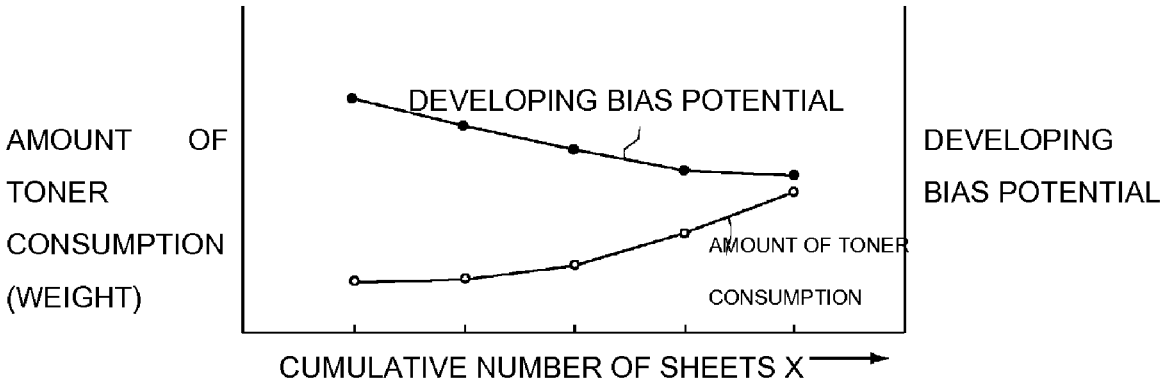
FIG. 4 is a graph illustrating a relation of a cumulative number of sheets, an amount of toner consumption, and a developing bias according to a preferred embodiment of the present invention.

As illustrated in the graph of FIG. 4, an amount of toner consumption tends to increase accompanying an increase in the cumulative number of sheets on which the image forming process has been performed. Such a phenomenon in which the amount of the toner consumption increases is considered to result from a fact that at an early stage, the toner with a relatively small diameter is preferentially consumed, and eventually, the toner with a large diameter is consumed. Therefore, if the developing bias is maintained constant, a toner density increases accompanying an increase in the cumulative number of sheets. Accordingly, it is necessary to reduce the developing bias accompanying the increase in the cumulative number of sheets and to maintain the toner density constant. Therefore, as illustrated in FIG. 3, the developing bias is determined by a linear function of the cumulative number of sheets on which the image forming process has been performed so that the developing bias is decreased accompanying the increase in the cumulative number of sheets. Other than the method for determining the developing bias by the function as in the above example, the developing bias may be set at a prescribed value for each prescribed range of cumulative number of sheets.

The image forming device 1 includes a control unit 50 which controls an operation necessary for the image forming process. The control unit 50 includes a Central Processing Unit (CPU) 51, a Read Only Memory (ROM) 52, and a Random Access Memory (RAM) 53. The CPU 51 carries out a computation process necessary for controlling the image forming process. The ROM 52 stores a program or the like necessary for the computation process. The RAM 53 stores data read from the IC chip 37, and stores a number of sheets on which the image forming process has been performed.

The control unit 50 reads the data D1 through D4 from the IC chip 37, stores the read data D1 through D4 in the RAM 53, and carries out the computation process. The control unit 50 determines a set value of the developing bias, and adjusts the variable power source 36 in accordance with the set value to control the developing bias. Each time the paper detecting sensor 43 detects the fed paper, the control unit 50 carries out an update process by adding to the data D4 the cumulative number of sheets stored in the RAM 53. When the image forming process ends, the control unit 50 transmits the updated data D4 of the cumulative number of sheets to the reader/writer 54, and updates the data D4 stored in the memory 301 of the IC chip 37.

Figure 5:
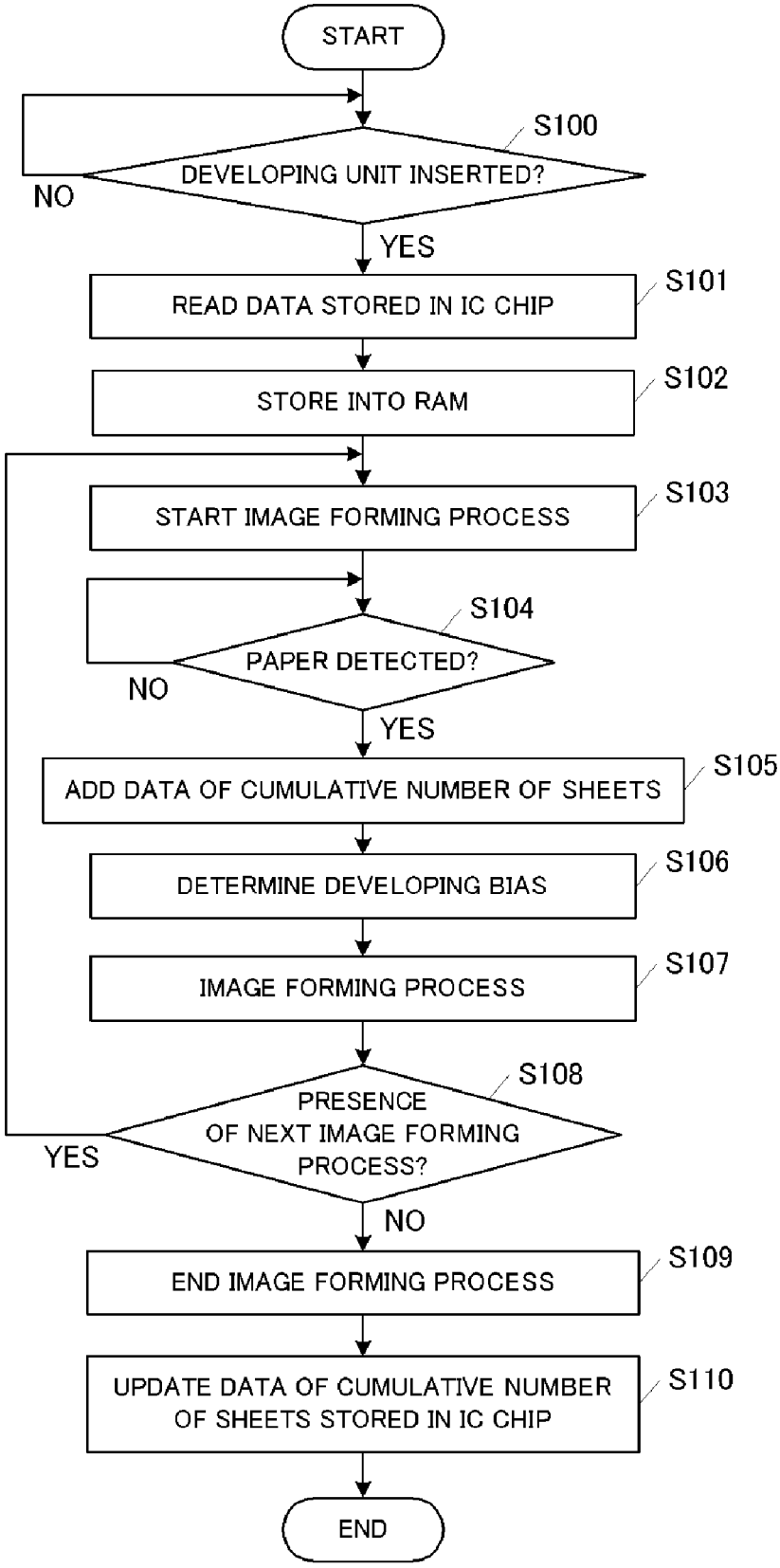
FIG. 5 is a flowchart illustrating a process flow relating to a control of the developing bias according to a preferred embodiment of the present invention.

FIG. 5 is a flowchart illustrating a processing flow relating to a control of the developing bias. The control unit 50 checks whether or not the developing unit 3 has been inserted (step S100). When the developing unit 3 is inserted, the control unit 50 reads the data stored in the IC chip 37 mounted on the developing unit 3 (step S101). The read data is stored into the RAM 53 (step S102). When an image forming process is started (step S103), the control unit 50 checks whether or not the paper detecting sensor 43 has detected paper (step S104). When the fed paper is detected, an addition process is carried out on the data of the cumulative number of sheets (step S105). The control unit 50 calculates the developing bias in accordance with the read function, and determines the developing bias (step S106). Then, an image forming process is executed (step S107). Next, the control unit 50 checks a presence or an absence of a subsequent image forming process (step S108). In case of a presence of a subsequent image forming process, the process returns to step S103, and the image forming process is started. In case of an absence of a subsequent image forming process, the image forming process is ended (step S109). Then, the control unit 50 carries out an update process for rewriting the data of the cumulative number of sheets stored in the IC chip 37 into the data of the cumulative number of sheets stored in the RAM 53 (step S110).

As described above, according to a preferred embodiment of the present invention, the IC chip 37 mounted on the developing unit 3 stores information relating to the developing bias according to a property of the developing unit 3. Accordingly, even when a plurality of types of the developing unit 3 are being replaced, the image forming process can be executed with an optimum developing bias in accordance with the information of the inserted developing unit 3. Even when the developing roller 30 is replaced at a recycling of the developing unit 3, just the data stored in the IC chip 37 may be rewritten. As a result, it becomes unnecessary to rewrite the data stored in the device main body, and the developing unit 3 may be recycled smoothly and easily.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. A developing unit, which is removably inserted in an image forming device, the developing unit comprising:

an accumulating chamber arranged to accumulate a developer;

a developing member arranged to move the developer onto an image carrier to form an image; and a storage medium arranged to store control information for determining a developing bias to be applied to the developing member and usage performance information of the developing unit necessary for determining the developing bias; wherein the usage performance information is a cumulative number of sheets on which an image forming process has been performed by the developing unit;

the storage medium is an integrated circuit chip, and the integrated circuit chip is mounted on an outer surface of the accumulating chamber; and the control information includes data relating to a function for determining the developing bias and data relating to an invariable to be used in the function.

2. The developing unit according to claim 1, wherein the developing bias is expressed by a linear function of the cumulative number of sheets.

3. The developing unit according to claim 2, wherein the linear function is a function in which the developing bias decreases accompanying an increase in the cumulative number of sheets.

4. An image forming device comprising:

a main body frame including a printer unit;

a developing unit, which is removably inserted in the printer unit, the developing unit including:

an accumulating chamber arranged to accumulate a developer;

a developing member arranged to move the developer onto an image carrier to form an image; and a storage medium arranged to store control information for determining a developing bias to be applied to the developing member and usage performance information of the developing unit necessary for determining the developing bias;

a developing bias determining unit which reads the control information and the usage performance information from the storage medium, and determines the developing bias to be applied to the developing member;

a developing bias control unit which applies the developing bias determined by the developing bias determining unit to the developing member; and a usage performance information updating unit which updates the usage performance information stored in the storage medium in accordance with a usage performance of the developing unit; wherein the usage Performance information is a cumulative number of sheets on which an image forming process has been performed by the developing unit;

the storage medium is an integrated circuit chip, and the integrated circuit chip is mounted on an outer surface of the accumulating chamber;

the developing bias determining unit includes a reader/writer which reads and writes information stored in the integrated circuit chip, and the reader/writer is arranged on the main body frame and faces the integrated circuit chip in a state in which the developing unit is inserted in the main body frame; and the control information includes data relating to a function for determining the developing bias and data relating to an invariable to be used in the function.

5. The image forming device according to claim 4, wherein the developing bias is expressed by a linear function of the cumulative number of sheets.

6. The image forming device according to claim 5, wherein the linear function is a function in which the developing bias decreases accompanying an increase in the cumulative number of sheets.

7. A control method of a developing bias comprising the steps of:

checking whether or not a developing unit has been inserted into an image forming unit;

reading from an integrated circuit chip mounted on the developing unit, when the developing unit is inserted, control information for determining the developing bias to be applied to a developing member and usage performance information of the developing unit necessary for determining the developing bias, wherein the control information includes data relating to a function for determining the developing bias and data relating to an invariable to be used in the function; and determining the developing bias by calculating the developing bias in accordance with the read function.

8. The control method of the developing bias according to claim 7, further comprising the step of storing the control information and the usage performance information read from the integrated circuit chip into a random access memory of a device main body of the image forming unit.

9. The control method of the developing bias according to claim 8, further comprising the step of adding a cumulative number of sheets to the usage performance information stored in the random access memory each time a sheet of fed paper is detected.

10. The control method of the developing bias according to claim 9, further comprising the step of rewriting the usage performance information stored in the integrated circuit chip into the usage performance information stored in the random access memory after an image forming process has been completed.

* * * * *